US008875791B2

(12) United States Patent
Erkol et al.

(10) Patent No.: US 8,875,791 B2
(45) Date of Patent: Nov. 4, 2014

(54) SEGMENTED FIBER OPTIC COILED TUBING ASSEMBLY

(75) Inventors: Zafer Erkol, Sugar Land, TX (US); Jamie Cochran, Kintore (GB); Maria Yunda, Kuala Lumpur (MY); Kellen Wolf, Taylor, ND (US)

(73) Assignee: Schlumberger Technology Corporation, Sugar Land, TX (US)

( * ) Notice: Subject to any disclaimer, the term of this patent is extended or adjusted under 35 U.S.C. 154(b) by 98 days.

(21) Appl. No.: 13/273,759

(22) Filed: Oct. 14, 2011

(65) Prior Publication Data

US 2012/0211231 A1 Aug. 23, 2012

Related U.S. Application Data

(60) Provisional application No. 61/394,035, filed on Oct. 18, 2010.

(51) Int. Cl.

| | |
|---|---|
| ***E21B 19/00*** | (2006.01) |
| ***E21B 19/22*** | (2006.01) |
| ***E21B 17/20*** | (2006.01) |
| ***E21B 17/02*** | (2006.01) |

(52) U.S. Cl.

CPC ..... *E21B 17/206* (2013.01); *E21B 19/22* (2013.01); *E21B 17/028* (2013.01)

USPC ..... 166/338; 166/77.2; 166/344; 166/242.6

(58) Field of Classification Search

USPC ..... 166/380, 338, 340, 77.2, 242.6, 242.7, 166/377, 241.2; 285/286.2, 256, 382

See application file for complete search history.

(56) References Cited

U.S. PATENT DOCUMENTS

| | | | |
|---|---|---|---|
| 470,514 | A | 3/1892 | Simpson |
| 587,695 | A | 8/1897 | Billing et al. |
| 638,554 | A | 12/1899 | Bunton |
| 1,223,591 | A | 4/1917 | Layne |
| 1,329,479 | A | 2/1920 | Savon |
| 1,693,839 | A | 12/1928 | Faudi |
| 1,995,616 | A | 3/1935 | Kamack |

(Continued)

FOREIGN PATENT DOCUMENTS

EP 1236860 A2 9/2002

OTHER PUBLICATIONS

BD Kendle Engineering Limited; "Coiled Tubing Tools-Section 3: Inline Conectors"; printed Mar. 23, 2007. www.bdkendle.co.uk/Coiled_Tubing.

(Continued)

*Primary Examiner* — James Sayre

(74) *Attorney, Agent, or Firm* — Michael Flynn; Timothy Curlington; Robin Nava

(57) ABSTRACT

A fiber optic coiled tubing assembly of multiple segments and coupling mechanism therefor. The assembly may be assembled from multiple coiled tubing segments which are pre-loaded with fiber optic line. Thus, the coupling mechanism may be employed for physical coupling of the coiled tubing segments as well as communicative coupling of the lines of the separate segments to one another. As such, pumping of a single fiber optic line through the coiled tubing assembly following coupling of the segments may be avoided. This may be of particular benefit for offshore operations where the joining of multiple coiled tubing segments is likely due to crane load capacity limitations and where such pumping may consume vast amounts of time.

19 Claims, 6 Drawing Sheets

(56) References Cited

U.S. PATENT DOCUMENTS

| | | | | |
|---|---|---|---|---|
| 2,300,517 | A | 11/1942 | Milton | |
| 2,647,770 | A | 8/1953 | Tollefsbol | |
| 4,752,111 | A * | 6/1988 | Fisher | 385/55 |
| 5,348,088 | A | 9/1994 | Laflin et al. | |
| 5,524,937 | A * | 6/1996 | Sides et al. | 285/123.1 |
| 5,829,795 | A | 11/1998 | Riesselmann | |
| 5,894,536 | A * | 4/1999 | Rifkin et al. | 385/99 |
| 6,009,216 | A * | 12/1999 | Pruett et al. | 385/12 |
| 6,059,338 | A | 5/2000 | Diederichs | |
| 6,098,727 | A * | 8/2000 | Ringgenberg et al. | 175/325.2 |
| 6,474,701 | B1 | 11/2002 | Bowles et al. | |
| 7,152,674 | B2 | 12/2006 | Bowles | |
| 7,237,809 | B2 | 7/2007 | Connell | |
| 7,484,772 | B2 | 2/2009 | Thorensen | |
| 7,637,539 | B2 | 12/2009 | McKee et al. | |
| 7,775,289 | B2 * | 8/2010 | McKee et al. | 166/380 |
| 7,827,668 | B2 * | 11/2010 | McKee et al. | 29/516 |
| 8,424,595 | B2 * | 4/2013 | Sach | 166/54.5 |
| 2001/0030048 | A1 * | 10/2001 | Mackenzie et al. | 166/380 |
| 2002/0007945 | A1 * | 1/2002 | Neuroth et al. | 166/66 |
| 2004/0045704 | A1 | 3/2004 | Bowles | |
| 2004/0184871 | A1 | 9/2004 | Luft et al. | |
| 2004/0194950 | A1 * | 10/2004 | Restarick et al. | 166/66 |
| 2005/0098356 | A1 | 5/2005 | Chau | |
| 2005/0248151 | A1 | 11/2005 | Connell | |
| 2006/0157974 | A1 | 7/2006 | Luft et al. | |
| 2006/0243453 | A1 | 11/2006 | McKee | |
| 2007/0000669 | A1 | 1/2007 | Mckee et al. | |
| 2007/0235198 | A1 | 10/2007 | Parker | |
| 2008/0047716 | A1 | 2/2008 | McKee et al. | |
| 2008/0169094 | A1 | 7/2008 | Ehtesham et al. | |
| 2010/0084132 | A1 * | 4/2010 | Noya et al. | 166/254.2 |
| 2010/0101778 | A1 | 4/2010 | Lembcke | |
| 2011/0203803 | A1 * | 8/2011 | Zemlak et al. | 166/349 |
| 2012/0213525 | A1 * | 8/2012 | Ullah | 398/115 |

OTHER PUBLICATIONS

Search Report dated Dec. 8, 2011 for corresponding GB Application No. 1117926.4.

* cited by examiner

SEGMENTED FIBER OPTIC COILED TUBING ASSEMBLY

CROSS-REFERENCE TO RELATED APPLICATION

This application is entitled to the benefit of, and claims priority to, U.S. Provisional Patent Application Ser. No. 61/394,035 filed Oct. 18, 2010, the entire disclosure of which is hereby incorporated herein by reference

FIELD

Embodiments described relate to coiled tubing applications. In particular, coiled tubing applications that take place in offshore environments with communicative capacity. That is, particular tools and techniques are disclosed for equipping coiled tubing with fiber optic capacity for use in deep offshore operations.

BACKGROUND

Exploring, drilling and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to vertical wells of limited depth, it is not uncommon to find hydrocarbon wells exceeding 30,000 feet in depth. This may be particularly true in cases of offshore operations, where depth as measured from the platform is increased by the distance to the well head at the ocean floor.

In recognition of the potentially enormous expense of completing sophisticated wells such as those offshore, added emphasis has been placed on well monitoring and maintenance. That is, placing added emphasis on increasing the life and productivity of a given well may help ensure that the well provides a healthy return on the investment involved in its completion. Thus, over the years, well diagnostics and treatment have become more sophisticated and desirable facets of managing well operations.

The nature of offshore wells presents unique challenges in terms of well access and management. For example, during the life of a well, a variety of well access applications may be performed within the well with a host of different tools or measurement devices. Providing downhole access to such wells may necessitate more than simply dropping a wireline into the well with the applicable tool located at the end thereof. For example, in circumstances where a clean-out application is to be run or a deviated well section is present, coiled tubing is generally employed to provide access to wells of more sophisticated architecture.

A coiled tubing application provides a hydraulic line for use in a wellbore and is also particularly adept at providing access to deviated or tortuous well sections. During a coiled tubing operation, a spool of pipe (i.e., a coiled tubing) with a downhole tool at the end thereof is slowly straightened and forcibly pushed into the well. This may be achieved by running coiled tubing from the spool at the offshore platform, through a gooseneck guide arm and injector which are aligned over the conduit to the subsea well head. Thus, where a deviated well section is present, forces needed to drive the coiled tubing therethrough are available.

Well diagnostic tools and treatment tools may be advanced and delivered via coiled tubing as described above. Diagnostic tools, often referred to as logging tools, may be employed to analyze the condition of the well and its surroundings. Such logging tools may come in handy for building an overall profile of the well in terms of formation characteristics, well fluid and flow information, etc. In the case of production logging, such a profile may be particularly beneficial in the face of an unintended or undesired event. For example, unintended loss of production may occur over time due to the buildup of debris or other factors. In such circumstances, a logging tool may be employed to determine an overall production profile of the well.

With an overall production profile available, the contribution of various well segments may be understood. Thus, as described below, corrective maintenance in the form of a treatment application may be performed at an underperforming well segment based on the results of the described logging application. For example, in the case of debris buildup as noted above, a clean-out application may subsequently be employed at the location of the underperforming segment.

In recent years, fiber optics capacity has been added to coiled tubing. In this manner, downhole data such as that making up the noted production profile, may be acquired in real-time. That is, an accurate production profile may be obtained via coiled tubing without removing the entire coiled tubing for profile data to be interpreted in advance of running a treatment application.

Unfortunately, while coiled tubing with fiber optic capacity may be time saving once deployed, it may also be time intensive in assembly, particularly offshore. That is, as with any coiled tubing, its offshore assembly and use is guided by conditions that are particular to the offshore environment. For example, for any particular piece of equipment, its weight is generally limited to about 50 tons so as not to exceed the capacity of the crane at the offshore platform. However, in the case of say, a 2⅞ inch coiled tubing for deployment in a 20,000 foot well, its overall weight may easily exceed 70 tons. Therefore, the coiled tubing is generally cut into separate segments for separate ship to platform deliveries so as to make sure that the crane capacity is not exceeded.

In addition to the separate deliveries of separate coiled tubing segments, subsequent reassembly or re-coupling of the segments to one another is needed. However, a considerable amount of time is lost in equipping the assembled coiled tubing with a fiber optic line. That is, the assembled bare coiled tubing is equipped with fiber optics by pumping of the line through the tubing. This involves the rigging up, and later breaking down, of pressure generating equipment, waiting hours for the proper pressure bulkhead to be generated, and waiting several hours for the line to be pumped through the tubing. For the example scenario of a 20,000 foot well as noted above, it may take between about 7 and 12 hours for the pumping of the line alone.

In addition to the time lost waiting for the fiber optic to be pumped through the tubing, there are concerns over the line traversing the joints between the separate tubing segments. That is, connector mechanisms which are used in coupling separate coiled tubing segments to one another present a sudden reduced tubing inner diameter. Thus, in order to effectively equip the tubing with communicative capacity the advancing line should bypass such connector mechanisms without suffering communicative damage thereto. Offshore operators are ultimately left with the options of continuing to run separate logging and coiled tubing operations or running a single trip coiled tubing application that faces the risk of line damage and eats up a considerable amount time over the course of its assembly.

SUMMARY

A coiled tubing assembly is provided with first and second coiled tubing segments. Each segment is equipped with its own fiber optic line therethrough. The assembly is also provided with a coupling mechanism that couples to each of the coiled tubing segments and also accommodates a spliced mating of each line therein.

DETAILED DESCRIPTION

Embodiments are described with reference to certain fiber optic coiled tubing operations with a focus on segmented coiled tubing, in particular. As such, depicted embodiments focus on offshore operations which generally employ segmented coiled tubing when attaining access to depths of over about 15,000 feet. However, a variety of other operations may employ embodiments of the segmented fiber optic assembly as detailed herein. For example, on-shore field repairs of coiled tubing may benefit from embodiments detailed herein where fiber optics are involved. Regardless, embodiments described herein disclose a coupling mechanism for use in joining together separate coiled tubing segments and separate fiber optic lines simultaneously. Thus, challenges associated with the pumping of a single fiber optic line through the coiled tubing may be avoided.

Figure 1:
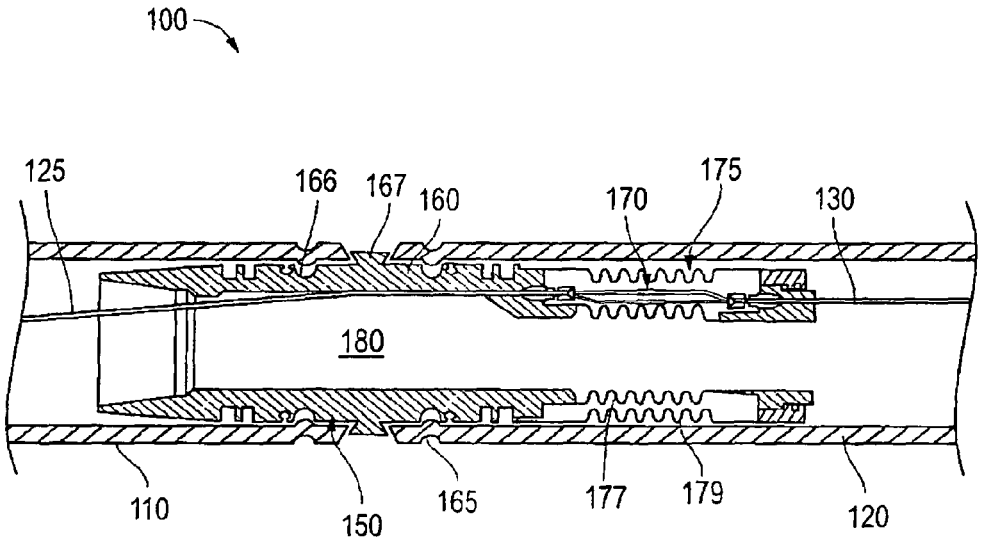
FIG. 1 is a side cross-sectional view of an embodiment of a coupling mechanism incorporated into a segmented fiber optic coiled tubing assembly.

Referring now to FIG. 1, a side cross-sectional view of an embodiment of a coupling mechanism 150 is depicted. The mechanism 150 is incorporated into a segmented fiber optic coiled tubing assembly 100. As with a conventional coiled tubing connector, the mechanism 150 is configured to physically secure and link together separate coiled tubing segments 110, 120. However, the mechanism 150 is also configured to accommodate fiber optics. More specifically, separate fiber optic lines 125, 130 of the separate coiled tubing segments 110, 120, may be coupled together at a spliced mating 170 disposed within the mechanism 150. In the embodiment shown, the mating 170 of the lines 125, 130 is housed within a flex joint 175 of the mechanism 150 as detailed further below.

Continuing with reference to FIG. 1, the coupling mechanism 150 includes a main body 160 with the above noted flex joint 175 extending therefrom. The main body 160 is configured similar to a conventional coiled tubing connector with a plurality of recesses 166 located at the outer surface of the body 160. In the embodiment shown, the recesses are of a dimpled shape, less than an inch or so in diameter. Regardless of the particular shape, matching depressions 165 may be formed in corresponding locations of the coiled tubing segments 110, 120.

In an embodiment, the matching depressions 165 are formed by way of a vice collar positioned about the segments 110, 120 in a region over the recesses 166. Thus, in the case of each discrete recess 166, an implement of the collar may be threadably tightened and extended toward each recess 166 to form each depression 165. Ultimately, at either side of a head 167 of the mechanism 150, coiled tubing segments 110, 120 are secured by the use of conforming depressions 165 anchored within recesses 166 of the coupling mechanism 150. Additionally, seal rings may be circumferentially incorporated about the outer surface of the main body 160 adjacent the recesses 166. Thus, formation of the depressions 165 as described may serve to anchor the segments 110, 120 as indicated, but also to sealably secure the mechanism 150 in place.

As indicated above, the coupling mechanism 150 is also equipped with a flex joint 175. The joint 175 accommodates fiber optics as noted. However, the joint 175 is also configured to provide a degree of structural flexibility to the mechanism 150. That is, with added reference to FIG. 2, coiled tubing segments 110, 120 are wound and unwound about a reel 210 and ultimately driven through an injector 240. Thus, during operations the tubing is repeatedly plastically deformed. However, the main body 160 of the coupling mechanism 150 is configured to retain its rigid and inflexible shape as it securely accommodates each tubing segment 110, 120. Given the limited length of the main body 160, perhaps 3-5 inches or so, its inflexibility is unlikely to result in damage to the adjacent deforming segments 110, 120 during operations.

In order to ensure that the added length to the coupling mechanism 150, in the form of the joint 175, also avoids damage to the deforming segments 110, 120 during operations, this joint 175 is flexible. More specifically, the flex joint 175 includes inner 177 and outer 179 flexible sleeve portions. As depicted, these portions 177, 179 are of a flexible accordion configuration, although other flexible varieties may be utilized. Regardless, in spite of the entire mechanism 150 now extending to 7-9 inches or so, the added length poses no additional hazard to the deforming segments 110, 120 (e.g. as they are advanced through a gooseneck of the injector 240 of FIG. 2).

Continuing with reference to FIG. 1, it is between the noted flexible sleeve portions 177, 179 that the spliced mating 170 of the separate fiber optic lines 125, 130 is positioned. Indeed, as shown, the uphole line 125 traverses the uphole tubing segment 110 and the coupling interior 180 until it is threaded through to the location between the sleeve portions 177, 179. As detailed further below, these portions 177, 179 may be sequentially fitted to the main body 160 depending on the protocol for splicing of the lines 125, 130 to one another. Regardless, continuous fiber optic capacity is provided through the mechanism 150 as the uphole line 125 transitions to the downhole line 130 via the flex joint 175.

Figure 2:
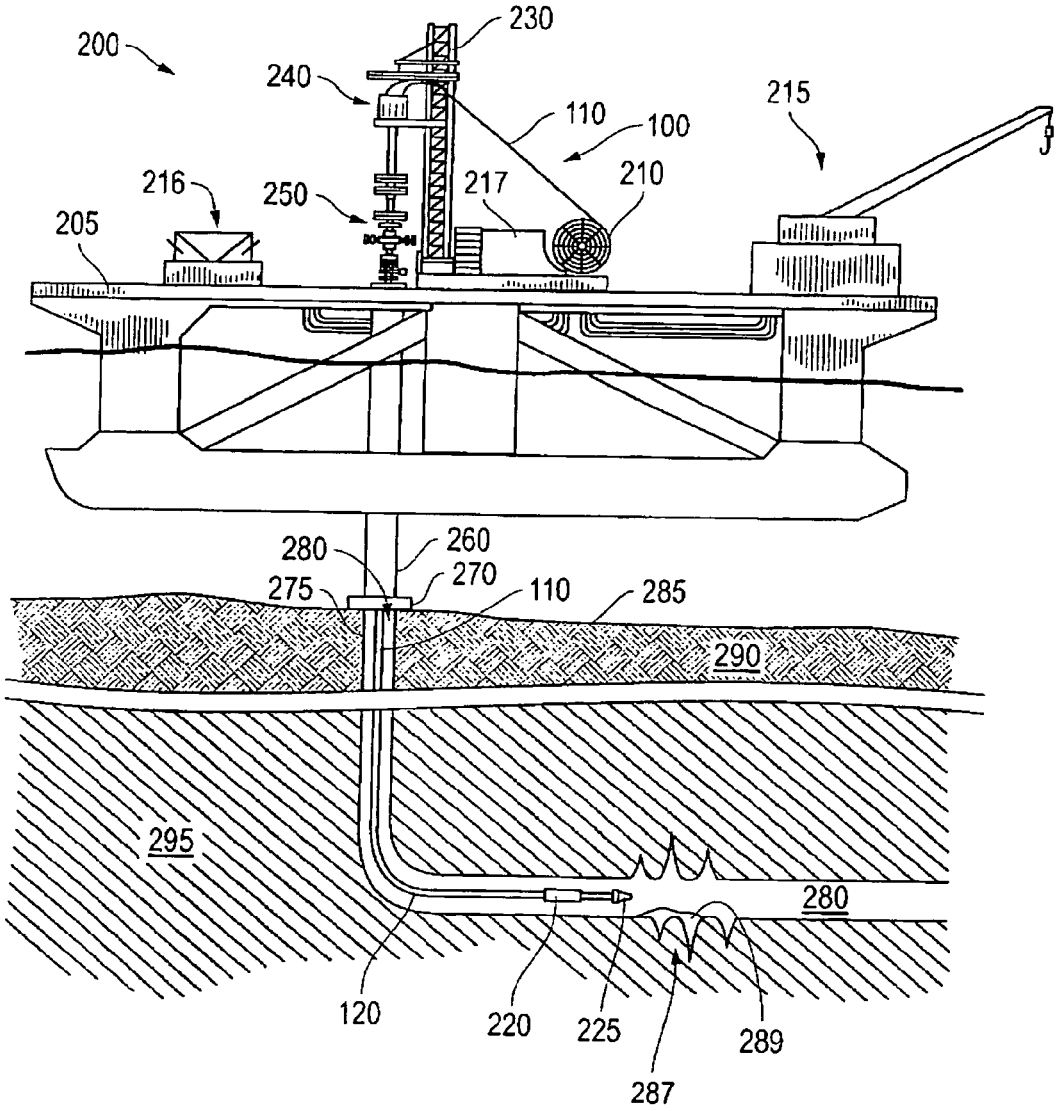
FIG. 2 is an overview of offshore well operations and equipment employing the segmented fiber optic coiled tubing assembly of FIG. 1.

Continuing now with reference to FIG. 2, an overview of offshore well operations 200 is depicted. In this overview, the segmented fiber optic coiled tubing assembly 100 of FIG. 1 is shown with the individual coiled tubing segments 110, 120 visible. Additionally, a host of offshore equipment 210, 215, 230, 240, 250, 216, 217 is also shown positioned at an offshore platform 205 for supporting coiled tubing operations.

As shown in FIG. 2, equipment in the form of an offshore crane 215 is provided for acquisition and transport of other equipment to the platform 205. Given the offshore nature of the crane 215, it is of a comparatively lighter weight and overall capacity as compared to those employed at an onshore oilfield. So, for example, the crane 215 may have a capacity of about 50 tons for any given load that it is to deliver to the platform 205. Thus, as a practical matter, heavier equipment may be delivered to the platform 205 in a modular manner, piece by piece. In the case of coiled tubing this may mean that it is delivered in segments 110, 120 and subsequently assembled on the platform 205. By way of specific example, a conventional 2⅞" coiled tubing having a length of about 20,000 feet may weigh in excess of 70 tons. However, if cut roughly in half, each 35 ton or so segment 110, 120 would be well under the weight capacity of the crane 215.

With added reference to FIG. 1 as described above, the separate coiled tubing segments 110, 120 may be coupled together through the use of a coupling mechanism 150. Indeed, so as to save considerable time in pumping fiber optics through the joined segments 110, 120, the coupling mechanism 150 may also accommodate a spliced mating 170 of different fiber optic lines 125, 130 pre-loaded within the separate segments 110, 120. As a practical matter, such pre-loading may include loading of a single line into a single coiled tubing that is then cut into the two segments 110, 120. As described further below, the coupling skid 216 of FIG. 2 may be employed as a structural guide for splicing fiber optics of the segments 110, 120 together as well as for physically coupling the segments 110, 120 to one another.

Continuing with reference to FIGS. 1 and 2, the splicing technique employed in joining separate fiber optic lines 125, 130 together may take a bit of time. However, this amount of time is unlikely to exceed a few hours. On the other hand, the amount of time to pump an uncut single fiber optic line through the joined segments 110, 120 is likely to exceed about 12 hours. This is particularly the case when accounting for the amount of time spent building an adequate pressure bulkhead and the rig-up and rig-down time eaten up by the pressure generating equipment. Furthermore, utilizing the coupling skid 216 and splice technique described below in connecting the lines 125, 130 avoids the possibility of fiber optic damage resulting from the blind pumping of fiber optics across the coupling mechanism 150 (or conventional connector).

Continuing with reference to FIG. 2, once assembled, the segmented fiber optic coiled tubing assembly 100 may be wound about a coiled tubing reel 210 and employed in an application. Specifically, the coiled tubing assembly 100 may be threaded through an injector 240 supported by a rig 230 at the surface of the platform 205. The assembly 100 may then be driven through valving and pressure regulating equipment 250, subsurface tubing 260 and ultimately through a well head 270 at the sea floor 285 for a downhole application as described below. The indicated driving of the assembly 100 as well as the conduct of the downhole application may be guided by a control unit 217 also provided at the surface of the platform 205.

In the depiction of FIG. 2, a well 280 is shown that is defined by casing 275 emerging below the well head 270. The well 280 traverses various subsea formation layers 290, 295 including a deviated section with a hydrocarbon production region 287. The production region 287 is hampered to a degree by the presence of debris 289, for example, sand. Thus, a water jet tool 225 is provided for a clean out of the debris 289. The use of the coiled tubing assembly 100 is particularly appropriate given the hydraulic nature of the clean out application as well as the challenging architecture of the well 280. Other applications or operations may be performed in the well by the coiled tubing assembly 100, such as, but not limited to, a well treatment operation, a fracturing operation, a milling operation, a scale removal operation, a perforating operation, a cementing operation such as cement squeezing, a cleanout operation, and a mechanical operation such as shifting sleeves, setting or removing plugs, and the like, as will be appreciated by those skilled in the art. Further, a communicative device 220 such as a logging tool may be incorporated into the downhole coiled tubing segment 120. Thus, real-time data regarding the application may be transmitted to the platform 205 (e.g. at the control unit 217). Such information may be carried over the coupled fiber optic lines 125, 130 of FIG. 1 as noted above. However, such communicative capacity may be achieved without the dozen or more hours at the platform 205 dedicated to the pumping of fiber optics through the entire assembly 100 down to the device 220.

Figure 3:
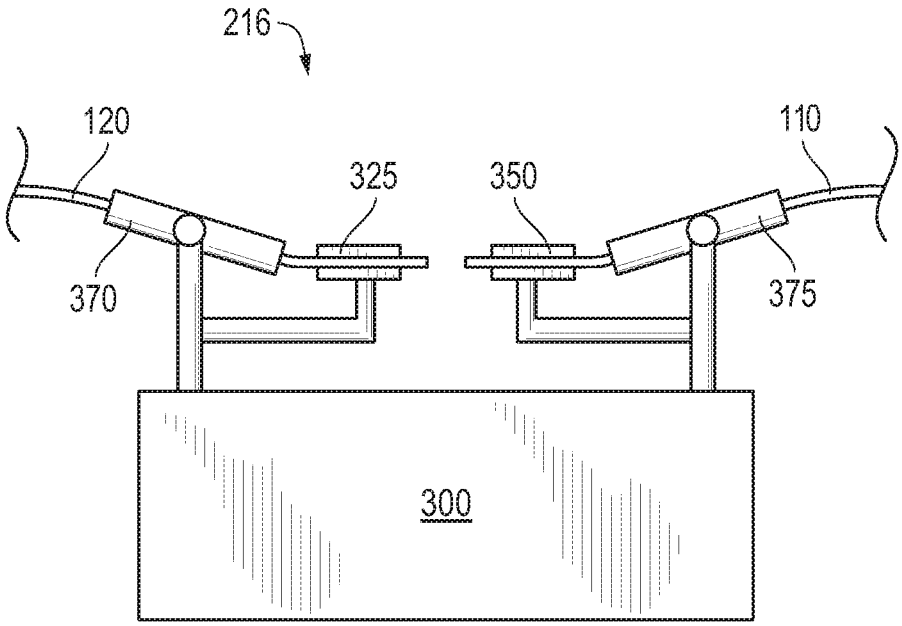
FIG. 3 is an enlarged view of a coiled tubing coupling skid of the equipment of FIG. 2 for accommodating separate segments of the assembly.

Referring now to FIG. 3, an enlarged view of the coupling skid 216 of FIG. 2 is shown. In this view, ends of the noted separate coiled tubing segments 110, 120 are shown secured to clamps 325, 350 adjacent one another. More specifically, a base 300 of the skid 216 accommodates support structure for guide arms 370, 375 oriented relative each clamp 325, 350.

In the embodiment shown, the uphole coiled tubing segment 110 may be guided through one guide arm 375 and stabilized by its corresponding clamp 350. In the same manner, the downhole coiled tubing segment 120 may be guided through the other guide arm 370 and stabilized by its corresponding clamp 325. In one embodiment, this guiding and clamping of the segments 110, 120 as shown is achieved in a wireless manner so as to allow an operator to remain a safe distance from the skid 216. Regardless, the ends of each segment 110, 120 are ultimately oriented toward one another in a stable fashion to allow subsequent communicative and structural coupling thereof as detailed below.

Figure 4A:
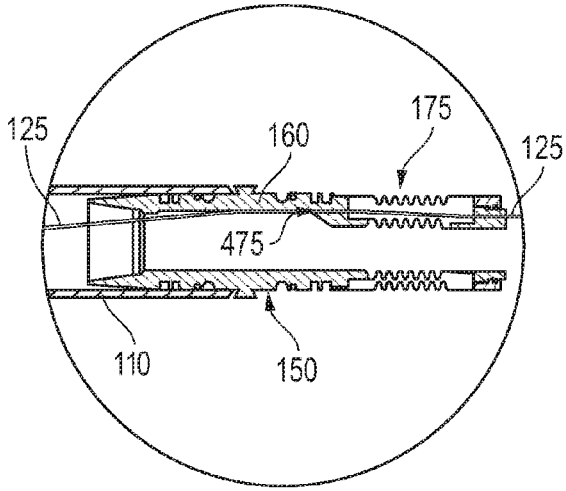
FIG. 4A is an enlarged view of the coupling mechanism of FIG. 1 coupled to a coiled tubing segment of FIG. 3 with a fiber optic line therethrough.

Referring now to FIG. 4A, an enlarged view of the coupling mechanism 150 is depicted. With the segments 110, 120 stably retained by the skid 216 of FIG. 3, an operator may now begin the process of physically and communicatively coupling the segments 110, 120 together via the mechanism 150. Indeed, as shown, the mechanism 150 is depicted within the uphole coiled tubing segment 110. In this view, the uphole fiber optic line 125 is shown extending a good distance beyond the end of the uphole segment 110. Depending on the overall length of the segment 110, this may be the natural result of slack available in the line 125. Alternatively, where desired, a portion of the end of the segment 110 may be cut back so as to expose more of the line 125 for running entirely through the coupling mechanism 150.

As shown in FIG. 4A, the uphole line 125 is threaded through a fiber optic channel 475 which traverses a portion of the main body 160 of the coupling mechanism 150 as well as the interior of the flex joint 175. Thus, the uphole line 125 is available for spliced coupling to the downhole line 130 as described below (see FIG. 4B).

Figure 4B:
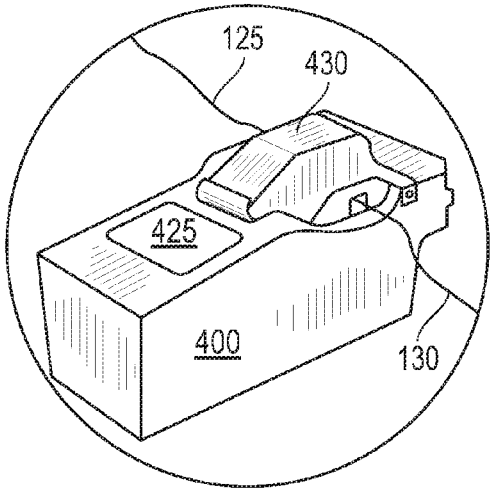
FIG. 4B is a perspective view of a fusion splicing device accommodating the fiber optic line of FIG. 4A and another fiber optic line for coupling thereof.

FIG. 4B reveals a fairly user-friendly fusion splicing device 400. In the embodiment shown, a controlling screen interface 425 is provided for the operator's use. Additionally, the device 400 may be a mobile, hand-held and battery powered mechanism weighing less than about 5 lbs. Thus, its employment at the confines of the skid 216 of FIG. 3 may be particularly user-friendly.

Continuing with reference to FIG. 4B, the above noted exposed portion of the uphole line 125 is directed toward the fusion splicing device 400. The device 400 is configured to physically and communicatively couple the uphole line 125 to the downhole line 130 of the downhole coiled tubing segment 120 (see FIG. 5). This is achieved through the use of any of a variety of heat driven splicing protocols. That is, once the lines 125, 130, and/or individual fibers thereof, are aligned within the splice housing 430, a splicing technique may be applied. Generally, in less than about a minute's time, coupling of the lines 125, 130 to form a spliced mating 170 therebetween may be completed (see FIG. 4C). Once more, such splicing may result in negligible signal loss, if any, to the communicative capacity over the mating 170.

Figure 4C:
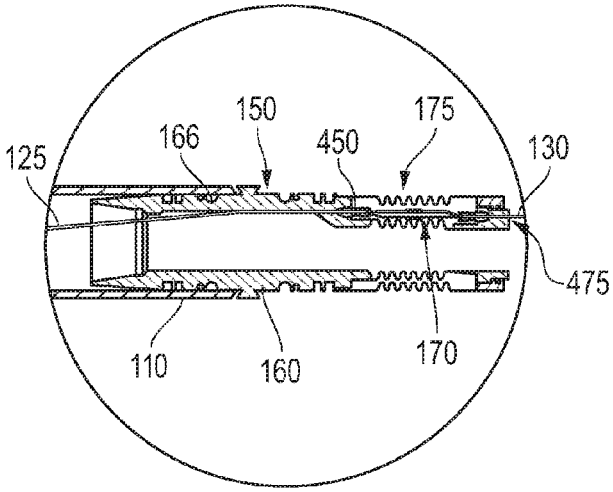
FIG. 4C is an enlarged view of the mechanism of FIG. 1 accommodating the lines of FIG. 4B and their coupling therein.

Referring now to FIG. 4C, the coupling mechanism 150 of FIG. 4A is again shown. However, in this view, the uphole fiber optic line 125, is shown drawn a bit back uphole into the channel 475 of the main body 160. Thus, the spliced mating 170 of the lines 125, 130 is now positioned at the interior of the flex joint 175 similar to the view of FIG. 1. In the embodiment shown, the spliced mating 170 is made up of several individually spliced together threads of the fiber optic lines 125, 130. However, in other embodiments, where multiple frequencies are employed over a single light path, the spliced mating 170 may include the coupling of no more than a single fiber optic thread. Additionally, in one embodiment, the positioning of the mating 170 at the flex joint 175, as well as securing of the joint 175 to the main body 160, may be accompanied by the addition of sealing or securing elements 450 at either side of the mating 170. Such elements may include a jam nut, vibration protection sleeve, and other features for maintaining isolation and stability of the mating 170.

Figure 5:
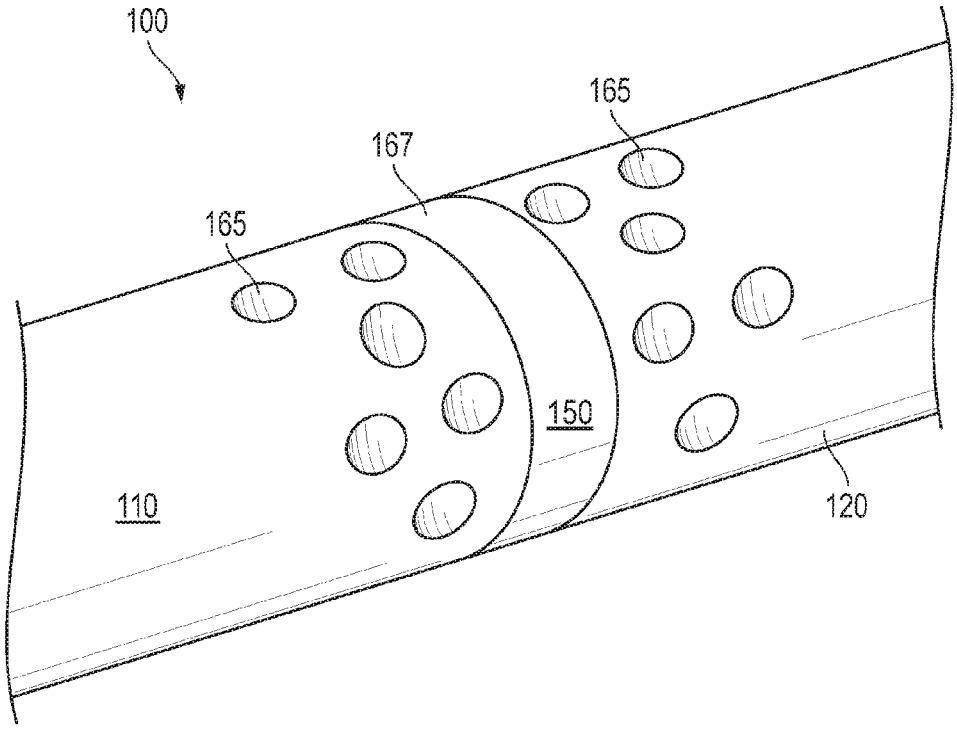
FIG. 5 is a perspective view of the assembly of FIG. 1 with the mechanism accommodating both coiled tubing segments and the lines of FIG. 4C.

Note that in the view of FIG. 4C, the downhole coiled tubing segment 120 of FIG. 5 is not yet visible. Again, it may be that the corresponding downhole fiber optic line 130 may be exposed to the degree visible in FIGS. 4B and 4C due to the amount of slack in light of the overall length of the line 130. Alternatively, where a larger amount of exposed line 130 is sought for the splicing and coupling described, a portion of the downhole segment 120 of FIG. 5 may be cut back. Regardless, once assembled to the degree depicted in FIG. 4C, the downhole segment 120 may be slid back over the exposed downhole portion of the coupling mechanism 150 to allow the assembly 100 of FIG. 5 to be completed.

Referring now to FIG. 5, a perspective view of the assembly 100 of FIG. 1 is shown. In this view, the head 167 of the coupling mechanism 150 is visible. With added reference to FIG. 4C, each of the coiled tubing segments 110, 120 are now physically secured to the main body 160 of the underlying mechanism 150. As described above, this physical security may be attained by the formation of depression 165 conformingly secured within recesses 166 of the body 160.

Figure 6:
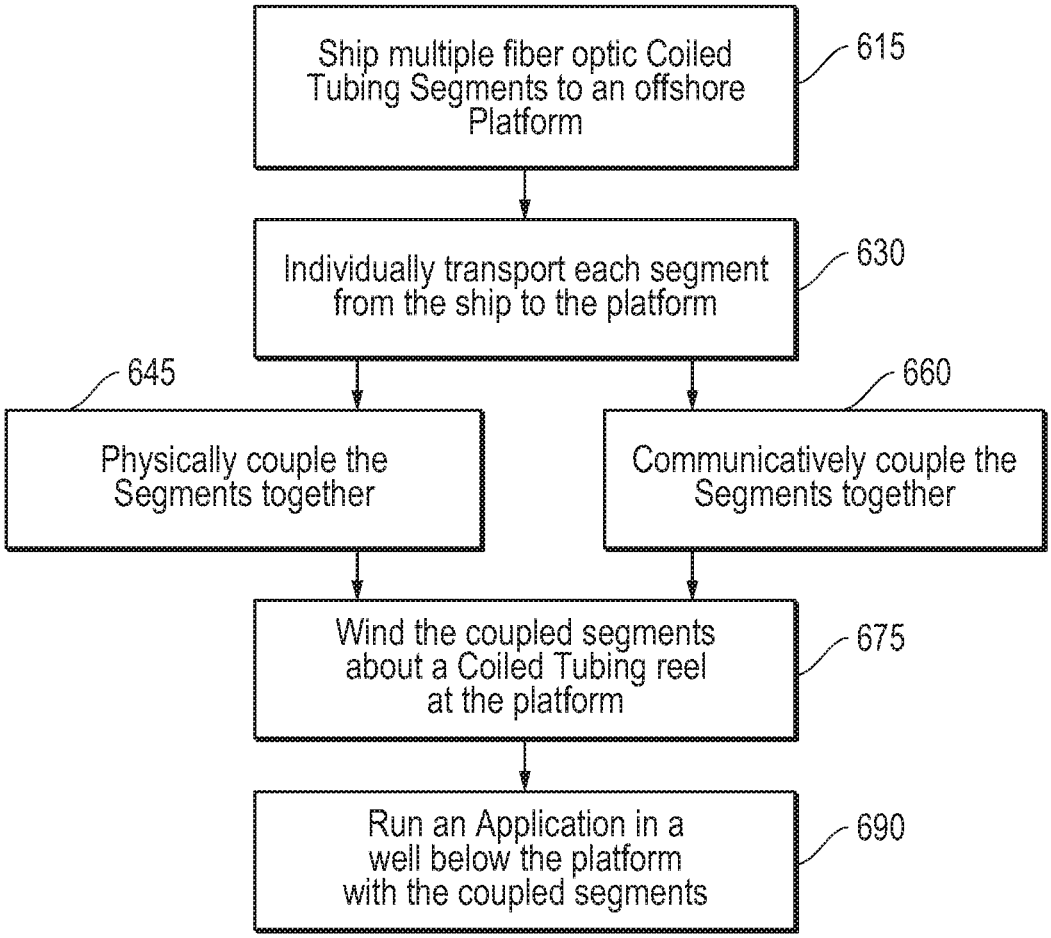
FIG. 6 is a flow-chart summarizing an embodiment of employing a segmented fiber optic coiled tubing assembly.

Referring now to FIG. 6, a flow-chart summarizing an embodiment of employing a segmented fiber optic coiled tubing assembly is shown. Notably, each coiled tubing may be provided fiber optic capacity on shore and subsequently shipped to an offshore platform as indicated at 615. Because the assembly is provided to the platform by way of separate segments which may be individually transported thereto, concern over offshore crane capacity is substantially reduced (see 630). At the same time, the utilization of an embodiment of a coupling mechanism as detailed hereinabove allows for the physical and communicative coupling of the segments together at the platform as indicated at 645 and 660. Thus, once wound about a coiled tubing reel as indicated at 675, a follow-on coiled tubing application may be run with the coupled segments as indicated at 690.

Embodiments described hereinabove include mechanisms, assemblies and techniques which allow for the effective avoidance of offshore pumping of fiber optics through coiled tubing for offshore fiber optic coiled tubing applications. As a result, time is saved in assembling a segmented fiber optic coiled tubing assembly. Further, the risk of fiber optic damage due to pumping is reduced without having the logging and coiled tubing operations be run separately.

The preceding description has been presented with reference to presently disclosed embodiments. Persons skilled in the art and technology to which these embodiments pertain will appreciate that alterations and changes in the described structures and methods of operation may be practiced without meaningfully departing from the principle, and scope of these embodiments. For example, embodiments are described herein with reference to the use of fiber optics for communication of information between a downhole device, such as a logging tool, and surface equipment. However, information such as pressure and temperature may be acquired and communicated over fiber optics of embodiments described herein without the presence of more sophisticated sensing equipment such as the noted logging tool. Additionally, the main body of the coupling mechanism may be a generally shorter structure configured to provide the fiber optic channel at one end while coupling to a conventional coiled tubing connector at the other. Furthermore, the foregoing description should not be read as pertaining to the precise structures described and shown in the accompanying drawings, but rather should be read as consistent with and as support for the following claims, which are to have their fullest and fairest scope.

The invention claimed is:

1. A coiled tubing assembly comprising:

a first coiled tubing segment with a first fiber optic line in an interior flowpath thereof;

a second coiled tubing segment with a second fiber optic line an interior flowpath thereof; and a coupling mechanism disposed in each of the segment flowpaths comprising a rigid main body for securing the segments thereto and coupled to each said segment and a flex joint coupled to the rigid body, the flex joint housing therein a spliced mating of the first line to the second line.

2. The coiled tubing assembly of claim 1 wherein said body comprises an outer surface with a plurality of recesses thereat for securing a plurality of depressions of said segments.

3. The coiled tubing assembly of claim 1 wherein said flex joint comprises inner and outer flexible sleeve portions for the accommodating.

4. The coiled tubing assembly of claim 3 further comprising securing elements coupled to said sleeve portions for isolating of the spliced mating therebetween.

5. The coiled tubing assembly of claim 1 wherein the fiber optic lines are configured for downhole data acquisition from a well.

6. The coiled tubing assembly of claim 5 wherein the data acquisition is one of direct fiber optic sensing via one of the lines and readings of a logging tool coupled to one of the lines.

7. A coupling mechanism for coupling an uphole fiber optic coiled tubing segment to a downhole fiber optic coiled tubing segment, the mechanism comprising:

a rigid main body for physically securing the segments from an interior portion of each of the tubing segments; and a flex joint coupled to the rigid body and housing therein a spliced mating of an uphole fiber optic line of the uphole segment to a downhole fiber optic line of the downhole segment.

8. The coupling mechanism of claim 7 wherein the spliced mating comprises multiple couplings of separate fibers of each of the lines.

9. The coupling mechanism of claim 7 wherein the coupled segments are configured for use in an offshore well application.

10. A method of performing a fiber optic coiled tubing application in a well, the method comprising:

communicatively coupling fiber optic lines of separate coiled tubing segments together utilizing a flex joint, the coupling of the fiber optic lines housed with the flex joint;

physically securing the segments together by utilizing a coupling mechanism disposed in an interior flowpath of each of the segments, the flex joint coupled to the coupling mechanism;

running the application in the well with the coupled lines and secured segments as a uniform assembly; and performing the application in the well.

11. The method of claim 10 wherein said securing comprises forming depressions in the segments to securably match recesses in a coupling mechanism disposed between the segments.

12. The method of claim 10 wherein said coupling comprises splicing the lines together with a fusion device to form a communicative mating therebetween.

13. The method of claim 12 wherein said splicing is a heat driven application with a duration of less than about one minute.

14. The method of claim 10 wherein the application is an offshore application, the method further comprising individually transporting each segment to an offshore platform for said coupling, said securing and said running.

15. The method of claim 14 further comprising winding the uniform assembly about a coiled tubing reel at the platform, said running comprising driving the assembly from the reel through an injector at the platform.

16. The method of claim 14 further comprising: loading a single fiber optic line into a single coiled tubing; and cutting the tubing into the segments prior to said transporting.

17. The method of claim 14 further comprising: acquiring data from the well; and transmitting the data to the platform over the lines during said running.

18. An offshore platform assembly comprising:

an offshore platform;

a fiber optic coiled tubing disposed at said platform; and a coupling skid disposed at said platform and configured to stabilize separate segments for communicative and physical coupling thereof in forming said fiber optic coiled tubing, wherein the separate segments are physically coupled via a rigid connector disposed in the flowpaths of each segment of the coiled tubing and the communicative coupling comprises inner and outer flexible sleeve portions receiving the communicative coupling and attached to the rigid connector.

19. The offshore platform assembly of claim 18 further comprising a crane disposed at said platform with a load bearing capacity below the weight of said tubing and above the weight of each segment.

* * * * *